US008381426B2

(12) United States Patent
Chang et al.

(10) Patent No.: US 8,381,426 B2
(45) Date of Patent: Feb. 26, 2013

(54) SYSTEM AND METHOD FOR WEAPON DISCHARGE INHIBITION

(75) Inventors: Timothy N Chang, Montville, NJ (US); Daphne Chang, legal representative, Montville, NJ (US); Biao Cheng, Edison, NJ (US)

(73) Assignee: New Jersey Institute of Technology, Newark, NJ (US)

( * ) Notice: Subject to any disclaimer, the term of this patent is extended or adjusted under 35 U.S.C. 154(b) by 95 days.

(21) Appl. No.: 13/043,035

(22) Filed: Mar. 8, 2011

(65) Prior Publication Data

US 2011/0271574 A1 Nov. 10, 2011

Related U.S. Application Data

(60) Provisional application No. 61/311,917, filed on Mar. 9, 2010.

(51) Int. Cl.
*F41A 17/06* (2006.01)

(52) U.S. Cl. ..... 42/70.08; 42/70.01

(58) Field of Classification Search ..... 42/70.01, 42/84

See application file for complete search history.

(56) References Cited

U.S. PATENT DOCUMENTS

| | | | | |
|---|---|---|---|---|
| 6,058,076 | A * | 5/2000 | Komninos | 367/135 |
| 6,163,504 | A * | 12/2000 | Komninos et al. | 367/135 |
| 6,219,952 | B1 * | 4/2001 | Mossberg et al. | 42/70.01 |
| 6,286,242 | B1 * | 9/2001 | Klebes | 42/84 |
| 6,321,478 | B1 * | 11/2001 | Klebes | 42/84 |
| 6,563,940 | B2 * | 5/2003 | Recce | 382/120 |
| 6,715,395 | B1 * | 4/2004 | Heibel | 89/1.11 |
| 6,817,130 | B2 * | 11/2004 | Ivanov | 42/70.06 |
| 7,362,231 | B2 * | 4/2008 | Bos | 340/665 |
| 2002/0170220 | A1 * | 11/2002 | Recce | 42/70.08 |
| 2004/0031180 | A1 * | 2/2004 | Ivanov | 42/70.11 |
| 2005/0134470 | A1 * | 6/2005 | Bos | 340/665 |

* cited by examiner

*Primary Examiner* — Jonathan C Weber
(74) *Attorney, Agent, or Firm* — Timothy X. Gibson, Esq; Gibson & Dernier LLP

(57) ABSTRACT

A firing inhibition system for a firearm includes an electromechanical actuator electrically connected to a dynamic grip recognition module including at least one sensor and a microcontroller, wherein the at least one sensor is located in a portion of a firearm operable to receive grip pressure from a user and wherein the at least one sensor is operable to transmit a signal to the microcontroller, wherein the microcontroller is operable to receive programming comprising grip pressure of an authorized user and is operable to interpret whether the grip pressure of the user matches the grip pressure of the authorized user, and to send a signal to the electromechanical actuator to actuate or to not actuate.

16 Claims, 14 Drawing Sheets

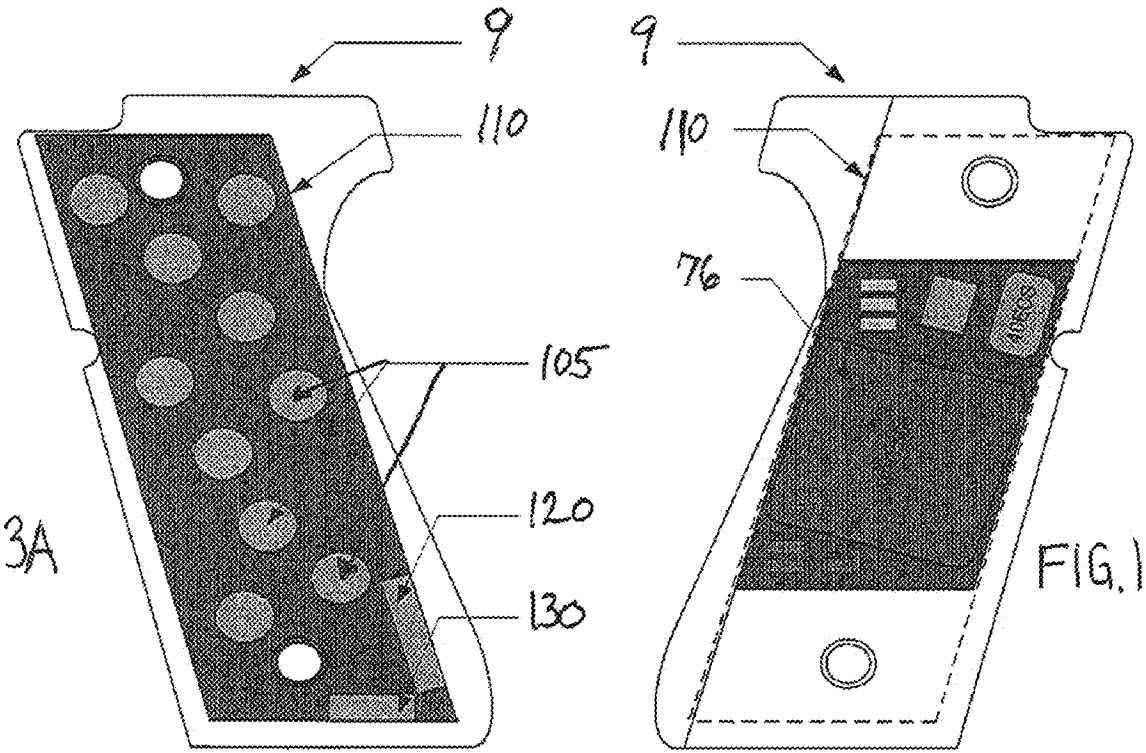
FIG. 13A
FIG. 13B
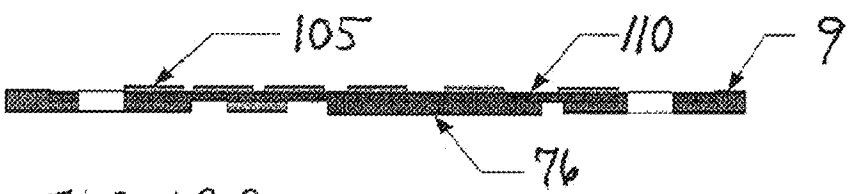
FIG. 13C 11
110A
105
120A
Front view 11
72
MCS3998
Rear view 11
110A
72
105
73

SYSTEM AND METHOD FOR WEAPON DISCHARGE INHIBITION

CROSS-REFERENCE TO RELATED APPLICATION(S)

This application claims the benefit of U.S. Provisional Patent Application No. 61/311,917 filed Mar. 9, 2010, the entirety of which is incorporated herein by reference.

GOVERNMENT RIGHTS

The research leading to the present invention was supported in part by a grant from the National Institute of Justice discretionary grant program (Grant No. 990595). Accordingly, the United States Government may have certain rights in the invention.

FIELD OF THE INVENTION

The present invention relates to firearms, and more specifically, to firearm firing inhibition devices and methods.

BACKGROUND OF THE INVENTION

In order for a firearm to have maximum utility and effectiveness, the firearm should be accessible and ready to fire when needed. However, in the interests of safety, it is not always desirable to keep a firearm ready to use at a moment's notice and within arm's reach. For example, firearms used for home defense typically must be kept in a secure location, such as a gun safe, away from small children, and/or secured with trigger locks, which typically must be used on unloaded guns. Keeping a firearm secured in such a manner is a large obstacle to being prepared for example in the event of a home invasion. Precious seconds are lost while the firearm is retrieved from the secure location, trigger locks are removed and the gun is loaded.

Moreover, there are times when firearms fall into the hands of one other than the owner. For example, it is not uncommon for firearms to be stolen and later used in connection with violent crimes. Another example is that during an altercation between law enforcement and criminals, the criminals may successfully take possession of the law enforcement personnel's firearm. In such instances it would be desirable for the firearm to be unusable to anyone but the owner.

Therefore there is a need for a firearm device that prevents the firearm from firing by anyone except an authorized user.

SUMMARY OF THE INVENTION

Accordingly, firearm firing inhibition technology is described herein which has been developed to stop events such as accidental shootings and unauthorized users discharging firearms. In the civilian sphere, this would allow the gun owner, but no one else, to fire the gun, thereby preventing accidental shootings in the home or elsewhere. The applications for law enforcement and military applications are similar. Employing the technology described herein, unauthorized discharge of firearms is prevented.

Firing mechanisms in a firearm are primarily based on percussion of the firing pin onto the primer of the cartridge. In personalized weapons technology, for example, biometric user recognition leads to a "go" or "no-go" signal. The latter is then realized as firing inhibition. A solenoid actuation system may be employed for firing inhibition. Although other electromechanical actuators (voice coil, piezoelectric, etc.) can be used, solenoid actuation system has the advantages of being low cost, compact, and fast.

The presently disclosed subject matter relates in one aspect to dynamic grip recognition and weapon discharge inhibition. The presently disclosed subject matter further relates to both a conformal sensor array and signal processor as well as weapon discharge inhibition mechanisms that may work in concert with one another. The subject matter is based in part on the concept that everyone holds a weapon in a different fashion, and that the unique pressure signature with which one holds a weapon acts as the necessary input to said weapon that allows it to fire. If the pressure signature is different than the pressure signature of the individual for whom the weapon is programmed the weapon will not discharge.

In accordance with one embodiment, a firing inhibition system for a firearm is disclosed which includes an electromechanical actuator electrically connected to a dynamic grip recognition module having at least one sensor and a microcontroller, wherein the at least one sensor is located in a portion of a firearm operable to receive grip pressure from a user and wherein the at least one sensor is operable to transmit a signal to the microcontroller, wherein the microcontroller is operable to receive programming comprising grip pressure of an authorized user and is operable to interpret whether the grip pressure of the user matches the grip pressure of the authorized user, and to send a signal to the electromechanical actuator to actuate or to not actuate.

In one embodiment the electromechanical actuator is a solenoid. The solenoid may be positioned in the firearm to inhibit motion of a trigger bar of the firearm. At least one block fixed on a surface of the trigger bar may be employed to operate as a stop against which a plunger of the solenoid may contact, preventing movement of the trigger bar.

In another embodiment a solenoid may be positioned in the firearm in the location of a firing pin, replacing the firing pin. The solenoid may be operable to reduce impact force from a hammer of the firearm to prevent primer detonation. Alternatively, the solenoid may operate to generate a force complementary to a permanent reductive impact force of a hammer of the firearm which is achieved by changing the restoring rate of a metal spring that drives the hammer, wherein when a signal is issued from the dynamic grip recognition module, the solenoid is actuated to generate a force complementary to the hammer force so the totality of two forces is adequate to detonate the primer. A solenoid which actuates with a speed sufficient to detonate primer of a cartridge may be employed. A solenoid with an actuation speed of at least 203.2 mm/sec may be employed.

In another embodiment a firing inhibition system is disclosed wherein the dynamic grip recognition module comprises a plurality of sensors disposed on at least one printed circuit board dimensioned to be located in the grip of a firearm. The sensors may be operable to obtain a temporal signature of user grip pressure before an act of firing is commenced and transmit signature information to the microcontroller. At least one of the sensors may be a tactile pressure sensor.

The arrangement of components necessary to actuate the electromechanical actuator may vary. In one embodiment, at least one printed circuit board is included and may include the microcontroller and a power and input/output connector. The printed circuit board may include a power management module and a pre-amplifier and optionally a battery.

In another embodiment, a firing inhibition system is disclosed in which the dynamic grip recognition module includes a first and second printed circuit board, wherein the first printed circuit board is associated with a left side of a firearm grip and the second printed circuit board is associated with a right side of the firearm grip, and the first and second printed circuit boards are electrically connected, wherein one of the printed circuit boards includes the microcontroller and the other printed circuit board includes at least a plurality of sensors. One of the printed circuit boards may further include a power and input/output connector. One of the printed circuit boards may include a power management module and a pre-amplifier and optionally a battery; and/or one of the printed circuit boards further comprises a clock, converter, switch, amplifier, and/or AND gate operably linked to the microcontroller.

In accordance with another embodiment, a firearm is disclosed having an electromechanical actuator electrically connected to a dynamic grip recognition module comprising at least one sensor and a microcontroller, wherein the at least one sensor is located in a portion of the firearm operable to receive grip pressure from a user and wherein the at least one sensor is operable to transmit a signal to the microcontroller, wherein the microcontroller is operable to receive programming comprising grip pressure of an authorized user and is operable to interpret whether the grip pressure of the user matches the grip pressure of the authorized user, and to send a signal to the electromechanical actuator to actuate or to not actuate.

In a further embodiment, methods are disclosed for inhibiting the firing of a firearm by providing a firearm with an electromechanical actuator and a dynamic grip recognition module, electrically connecting the actuator to the dynamic grip recognition module, the dynamic grip recognition module including at least one sensor and a microcontroller, positioning the sensor in a portion of the firearm operable to receive grip pressure from a user, wherein the at least one sensor is operable to transmit a signal to the microcontroller, programming the microcontroller with data relating to grip pressure of an authorized user, and programming the microcontroller to interpret whether the grip pressure of the user matches the grip pressure of the authorized user, and to send a signal to the electromechanical actuator to actuate or to not actuate.

BRIEF DESCRIPTION OF THE DRAWINGS

To assist those of ordinary skill in the relevant art in making and using the subject matter hereof, reference is made to the appended drawings, wherein:

FIGS. 13A-13C are schematic diagrams depicting front (FIG. 13A), rear (FIG. 13B) and side (FIG. 13C) views of a left side hand grip of a firearm including elements of a dynamic grip recognition module in accordance with one embodiment of the present disclosure.

It should be noted that the appended drawings illustrate only typical embodiments of this invention and are therefore not to be construed as limiting of its scope, for the invention may admit to other equally effective embodiments.

DETAILED DESCRIPTION OF THE INVENTION

The following is a detailed description of the invention provided to aid those skilled in the art in practicing the present invention. Those of ordinary skill in the art may make modifications and variations in the embodiments described herein without departing from the spirit or scope of the present invention. Unless otherwise defined, all technical and scientific terms used herein have the same meaning as commonly understood by one of ordinary skill in the art to which this invention belongs. The terminology used in the description of the invention herein is for describing particular embodiments only and is not intended to be limiting of the invention. All publications, patent applications, patents, figures and other references mentioned herein are expressly incorporated by reference in their entirety.

Figure 1:
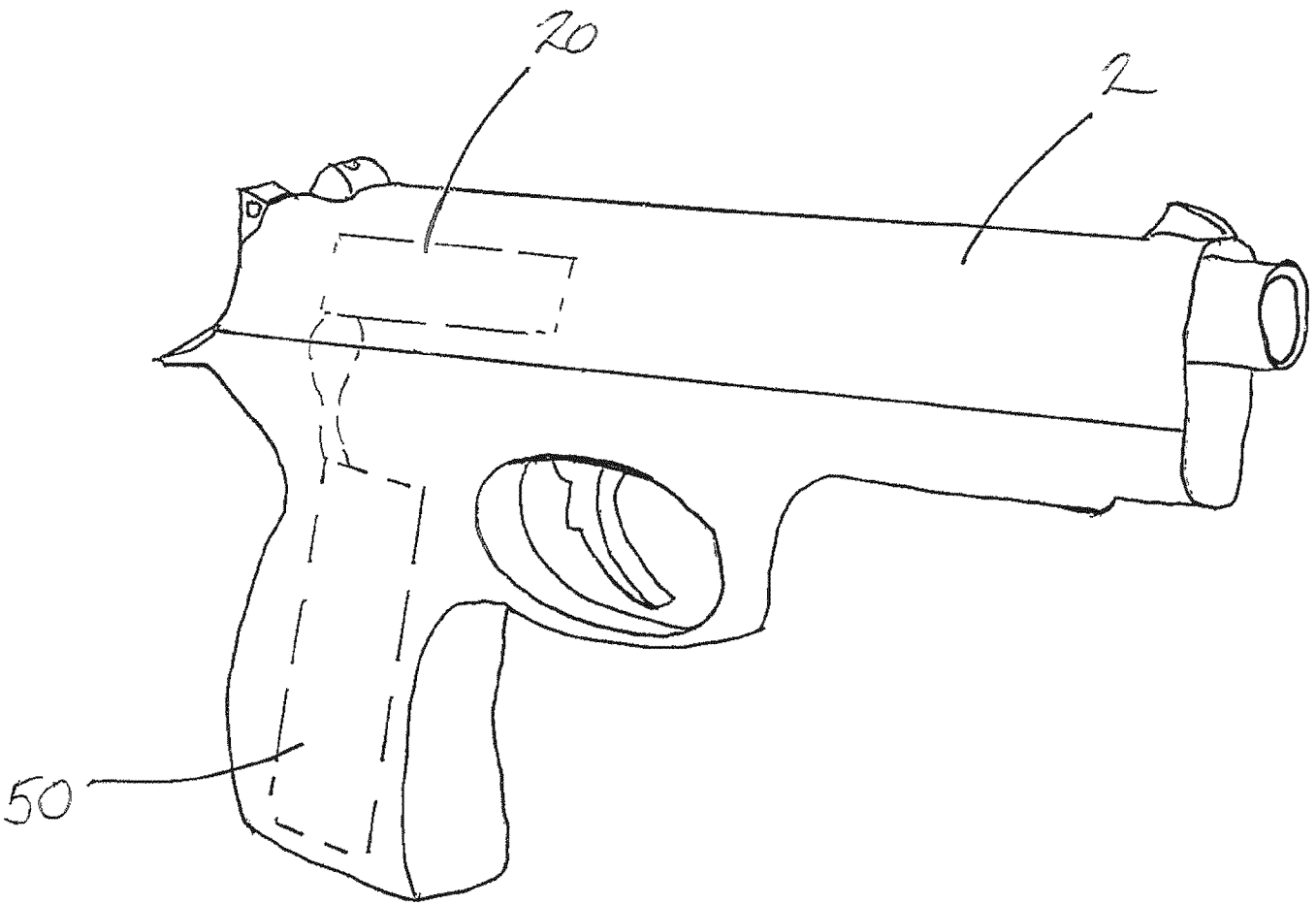
FIG. 1 is a side perspective view of a firearm including a firing inhibition system in accordance with one embodiment of the present disclosure.

Now referring to FIG. 1, in general a firearm 2 is equipped with a firing inhibition system including electromechanical actuator 20 electrically connected to dynamic grip recognition module 50 shown in phantom.

Firearm 2 may be any firearm that can be equipped with an electromechanical actuator and dynamic grip recognition module 50. For purposes of illustration the firearm 2 depicted herein is an automatic pistol as is well known in the art. Those skilled in the art will recognize the presently disclosed subject matter is easily incorporated into any automatic pistol such as a Beretta® automatic pistol and the like, as well as any automatic firearm having a grip including rifles and shotguns, etc.

Electromechanical actuator 20 may comprise a solenoid, voice coil, piezoelectric device or the like. The electromechanical actuator 20 is disposed in the firearm 2 so that it is operable to inhibit firing of the firearm.

Dynamic grip recognition module 50 is described in further detail herein below and in one embodiment essentially includes at least one printed circuit board (PCB) with electronics components including for example, a power management device, sensor amplifiers, and microprocessor(s); pressure sensors such as piezoelectric pressure sensors, piezoresistive pressure sensors, capacitive pressure sensors, etc.; and electrical interconnects and mechanical support. As will be apparent form the following discussion, the pressure sensors must be located on a portion of a firearm that receives a grip of a user. The remaining portions of the dynamic grip recognition module 50 may be located elsewhere on the firearm.

Figure 2:
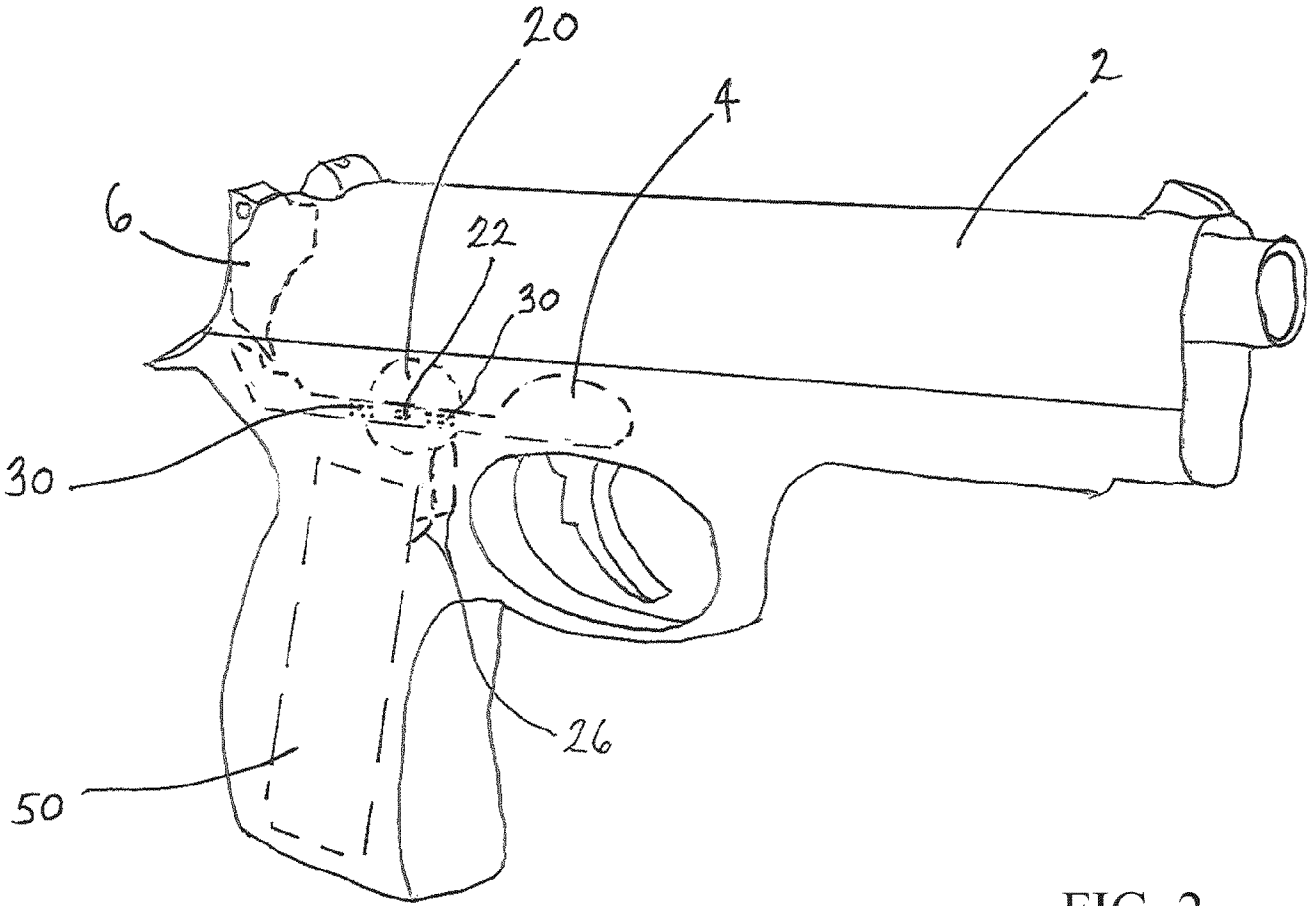
FIG. 2 is a side perspective view of a firearm including a firing inhibition system in accordance with one embodiment of the present disclosure.

Now referring to FIG. 2, in accordance with one embodiment, electromechanical actuator 20 is positioned and operable to disable the trigger bar 4 of firearm 2, which transmits finger trigger action mechanically into releasing the hammer 6. By blocking/disabling this transmission, the hammer 6 cannot actuate the firing pin (not shown), hence there is no strike on the cartridge primer.

Figure 3:
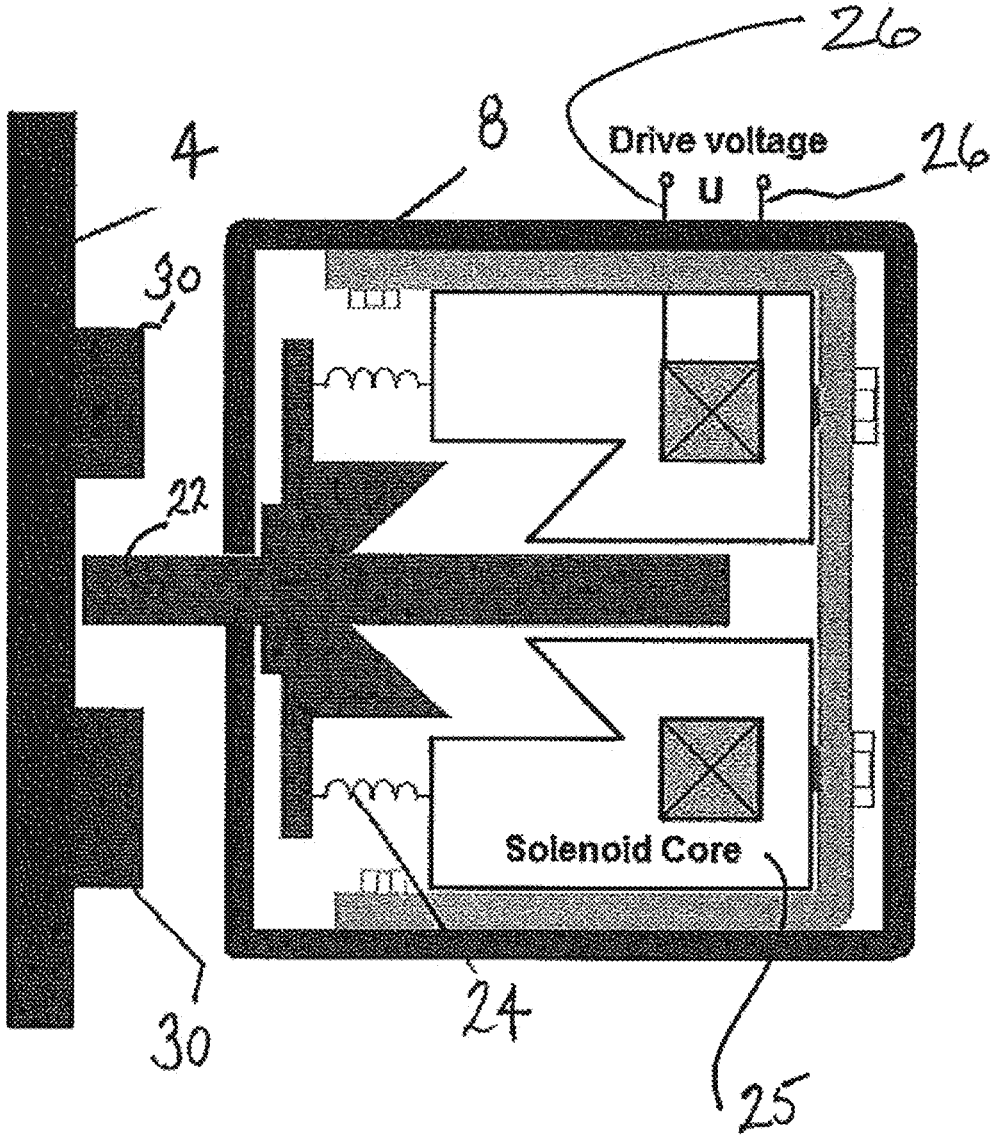
FIG. 3 is a cross-sectional, schematic view of a solenoid-based firing/blocking system in accordance with one embodiment of the present disclosure.

Now further referring to FIG. 3, in one embodiment, electromechanical actuator 20 is a solenoid operable to block the trigger transmission activity of a standard automatic firearm such as a Beretta pistol. Solenoid 20 includes plunger 22, spring 24, core 25 and connections 26 for connection to a power source and the dynamic grip recognition module 50. Suitable solenoids include low-profile solenoids available commercially from Magnetic Sensor Systems of Van Nuys, Calif. Solenoid 20 may include frame 28. The solenoid is disposed in the hollow magazine 8 or magazine receiving channel and electrically connected to the dynamic grip recognition module 50 located for example in the grip portion of firearm 2. As shown, the solenoid 20 is in the "off" position. With the help of stopper blocks 30 mounted on the trigger bar 4, the plunger 22 limits the travel of the trigger bar 4 when in the "off" position. For an unauthorized user, determined by the dynamic grip recognition module 50, described in further detail herein below, the de-energized solenoid firing/blocking system stays in the "off" position as shown. The hammer 6 will not fall to strike the firing pin although the pistol 2 has been triggered. For an authorized user, determined by the dynamic grip recognition module 50, the solenoid 20 drives the plunger 22 retracting back into the solenoid core 25 to release the blocked trigger bar 4. The shooting activity may then be completed.

Figure 4A:
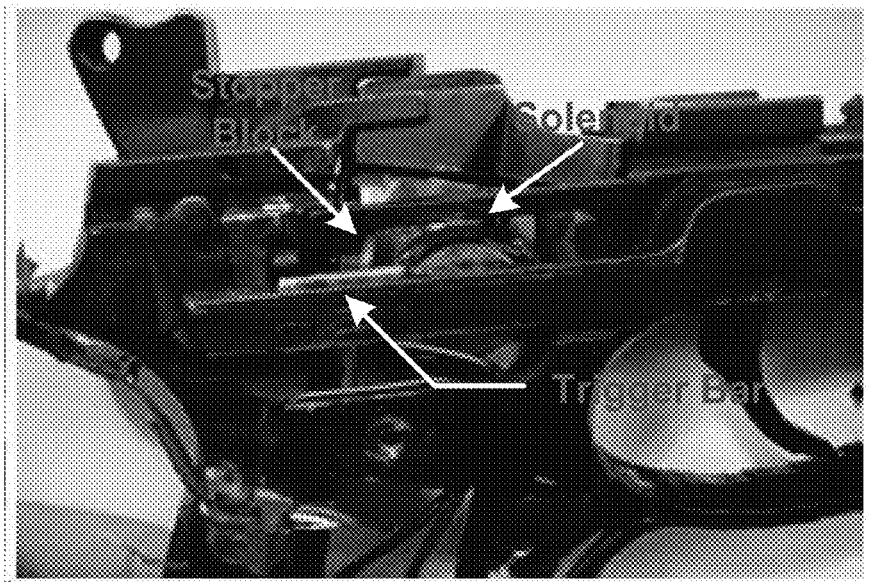
FIG. 4A is a photographic side view of a solenoid-based firing/blocking system installed in a firearm in accordance with one embodiment of the present disclosure.
Figure 4B:
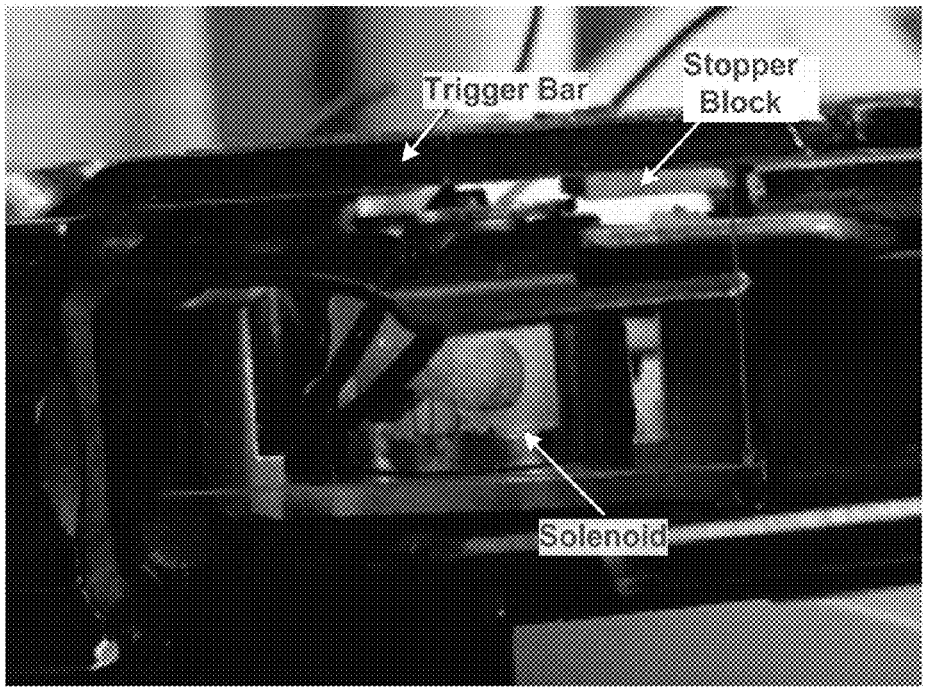
FIG. 4B is a photographic top view of a solenoid-based firing/blocking system installed in a firearm in accordance with one embodiment of the present disclosure.

The spring 24 connecting the plunger 22 and the core 25 supplies return force to restore the plunger 22 to its default de-energized position, i.e., "off" position, after each shoot activity in accordance with one embodiment. FIGS. 4A and 4B show an example of the solenoid 20 employed as a firing/blocking system assembled in a Beretta® handgun.

For an authorized user, the solenoid plunger 22 must retract totally before it touches the front stopper block 30 on the trigger bar 4 to avoid being stuck. One skilled in the art will recognize the solenoid 20 should actuate fast enough compared to the speed of the dynamic grip recognition module 50 and trigger pulling action. Experiments were conducted to test the dynamics of the solenoid 20 for use in a firing/blocking system in accordance with the present disclosures.

Travel range was set as 0.17 mm for testing in the experiments.

The displacement of the plunger for testing was measured by MTI-1000 Fotonic Sensor and collected by data acquisition card PCI-6024E and program LabVIEW 8.0. The performance characteristics of the solenoid, such as speed and power consumption with various sets of drive voltage and duty cycle were evaluated. Higher driving voltage resulted in greater speed but higher power consumption. Hence it may be desirable to tune the device to a driving voltage suitable to achieve an adequate speed while maximizing battery life. Parameters of an exemplary push-pull solenoid SMT-1913SL available from TSE Technology Co., Ltd. of Zhejiang, China, www.nbtse.com, are listed in Table 1.

TABLE 1

Parameters of push solenoid SMT-1913SL

| | | | |
|---|---|---|---|
| Plunger weight (g) | 4 | DC Voltage (volt) (Duty cycle less than 10%) | 9.5 |
| Total weight (g) | 20 | Resistance at 20° C. (Ω) | 89 |
| Number of turns | 1230 | Ampere turns at 20° C. (At) | 537 |

Figure 5:
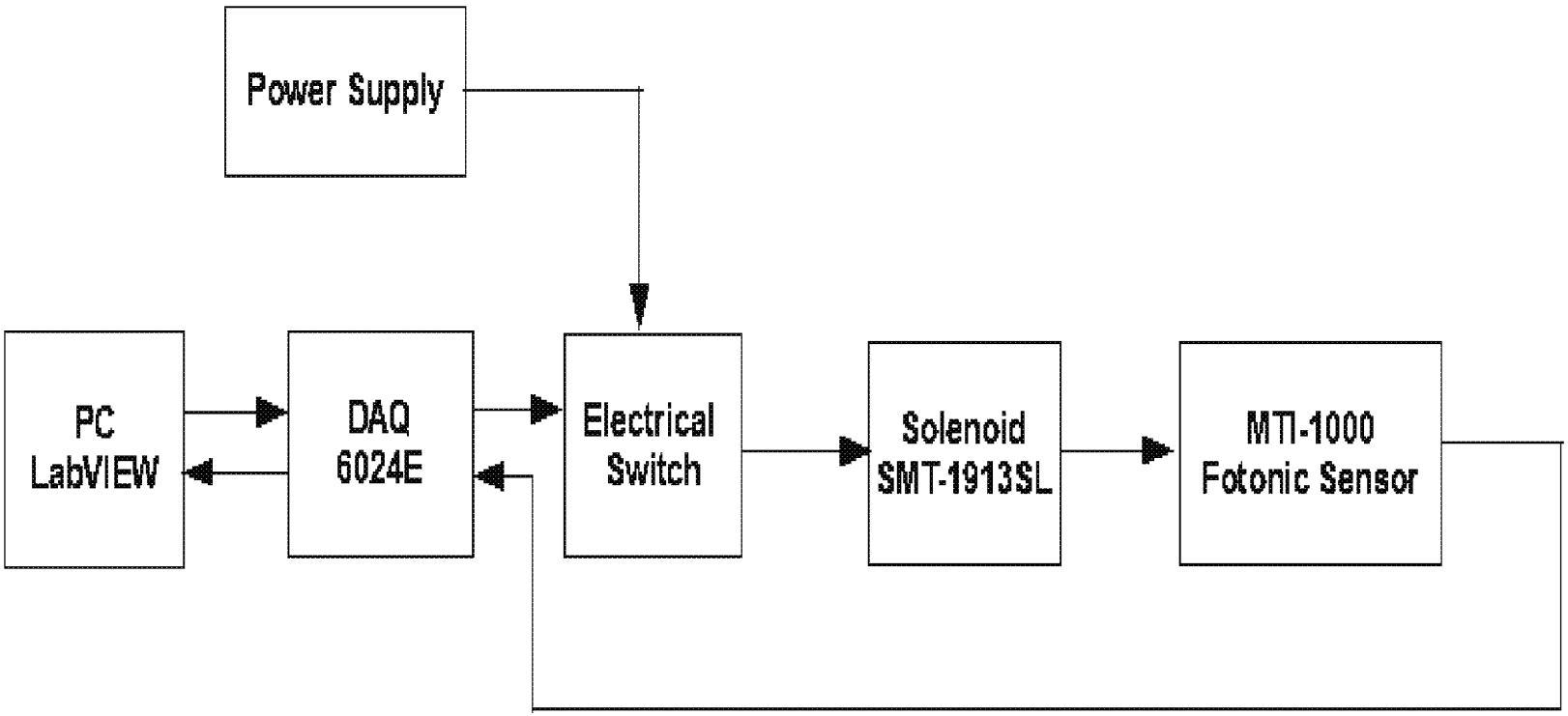
FIG. 5 is a schematic diagram of a solenoid dynamic test in accordance with one embodiment of the present disclosure.
Figure 6:
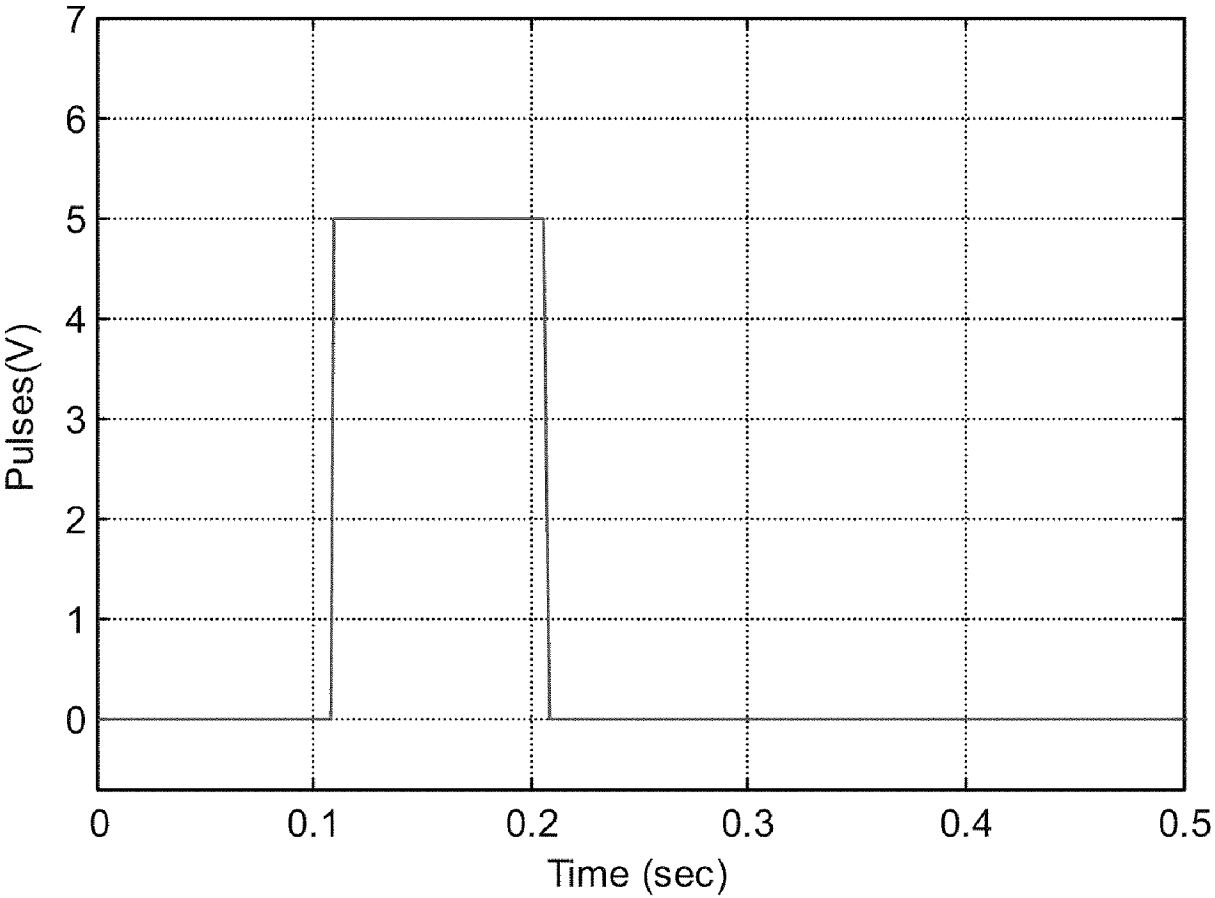
FIG. 6 is a graphical depiction of a drive voltage curve of a solenoid dynamic test in accordance with one embodiment of the present disclosure.
Figure 7:
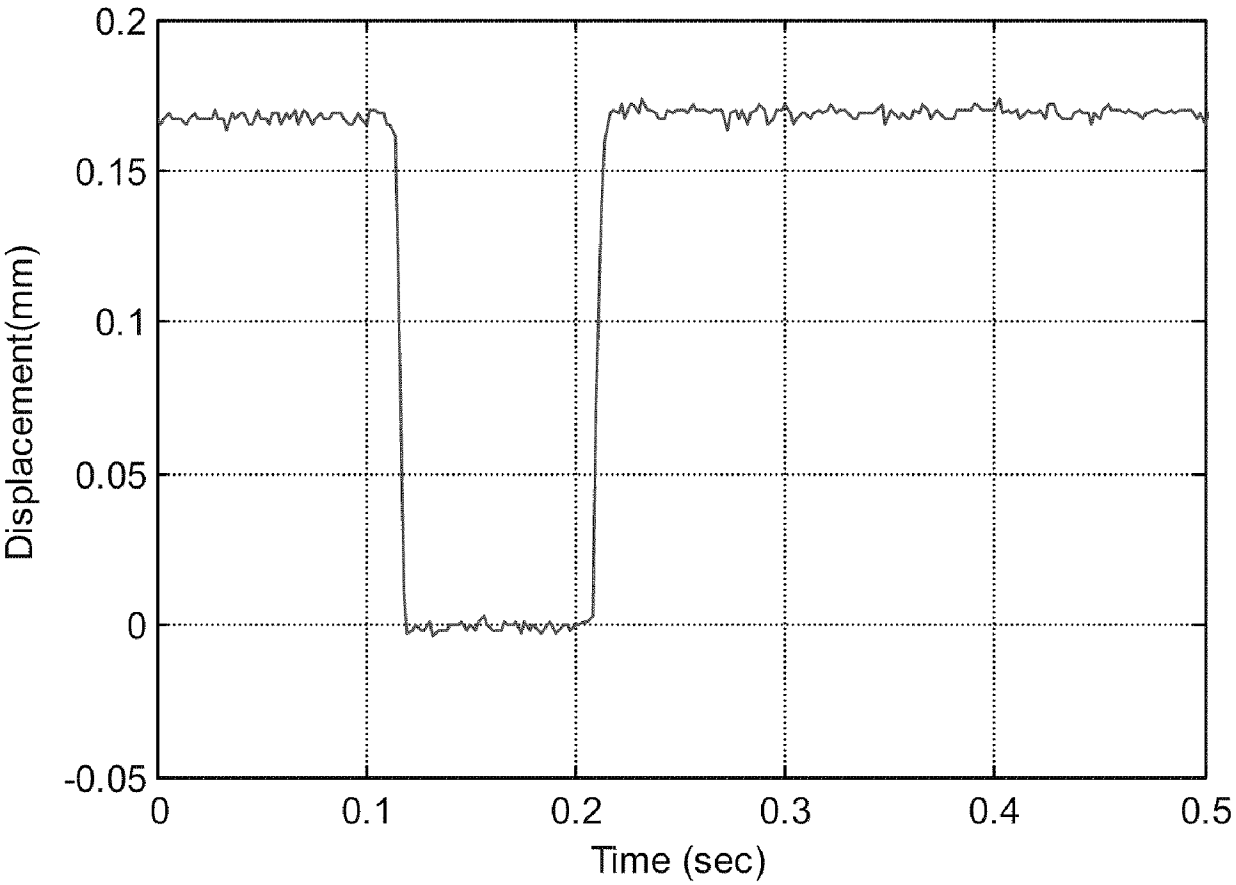
FIG. 7 is a graphical depiction of a displacement curve of a solenoid dynamic test in accordance with one embodiment of the present disclosure.
Figure 8:
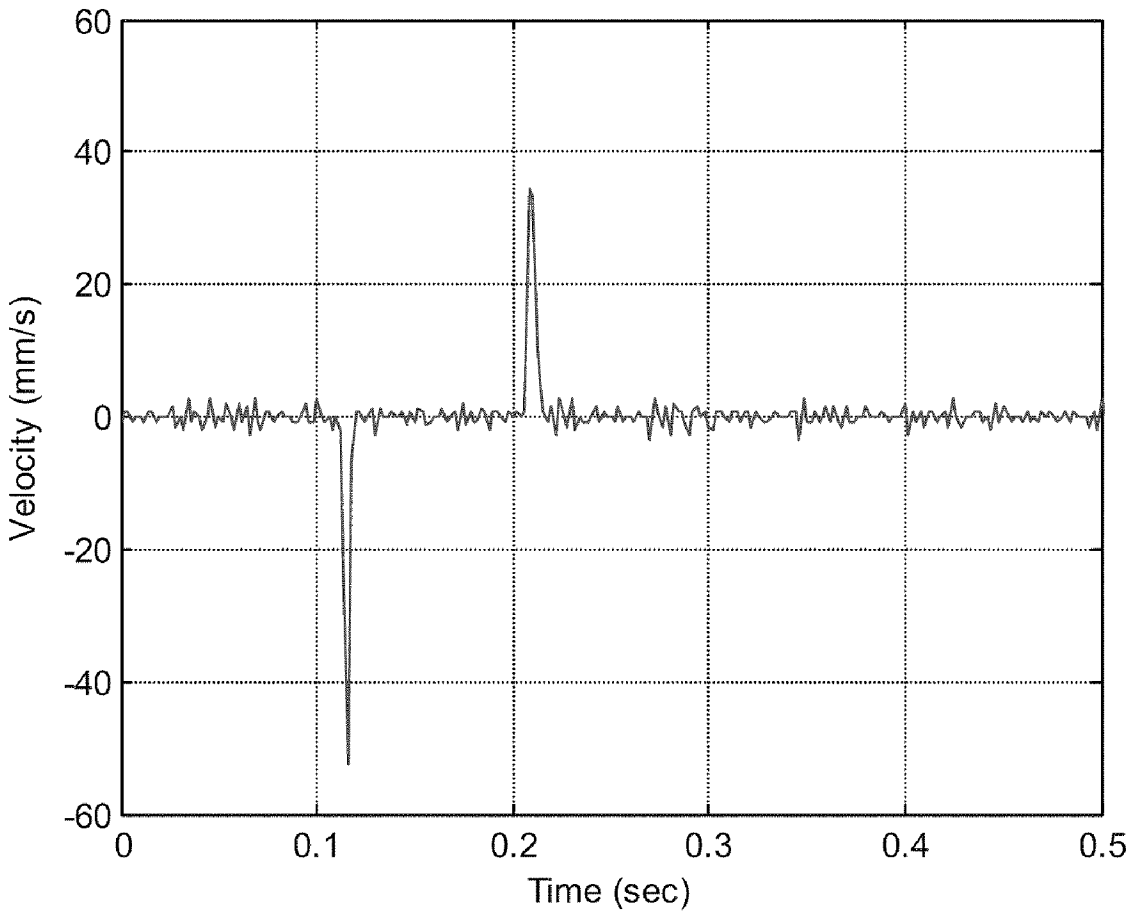
FIG. 8 is a graphical depiction of a velocity curve of a solenoid dynamic test in accordance with one embodiment of the present disclosure.

The schematic diagram for one exemplary embodiment of the solenoid dynamic test is shown in FIG. 5. The drive voltage, displacement and velocity curves are shown in FIGS. 6, 7 and 8, respectively. The drive signal was set to a series of periodical pulses with amplitude 5 volt and duty cycle 10%. Displacement represents the distance between the core and plunger cap of the solenoid. Table 2 lists the relative dynamic data analysis for the embodiment.

TABLE 2

Dynamic Analysis

| Amplitude U (volt) | Duty cycle (%) | Time t (sec) | Average speed v (m/s) | Maximum Speed vmax (m/s) | Momentum M = mvmax (Ns) | Kinetic energy $E = \frac{1}{2}mv^2$ (J) |
|---|---|---|---|---|---|---|
| 5 | 10 | $10 \times 10^{-3}$ | 0.017 | 0.055 | $2.2 \times 10^{-4}$ | $5.78 \times 10^{-7}$ |

Figure 9:
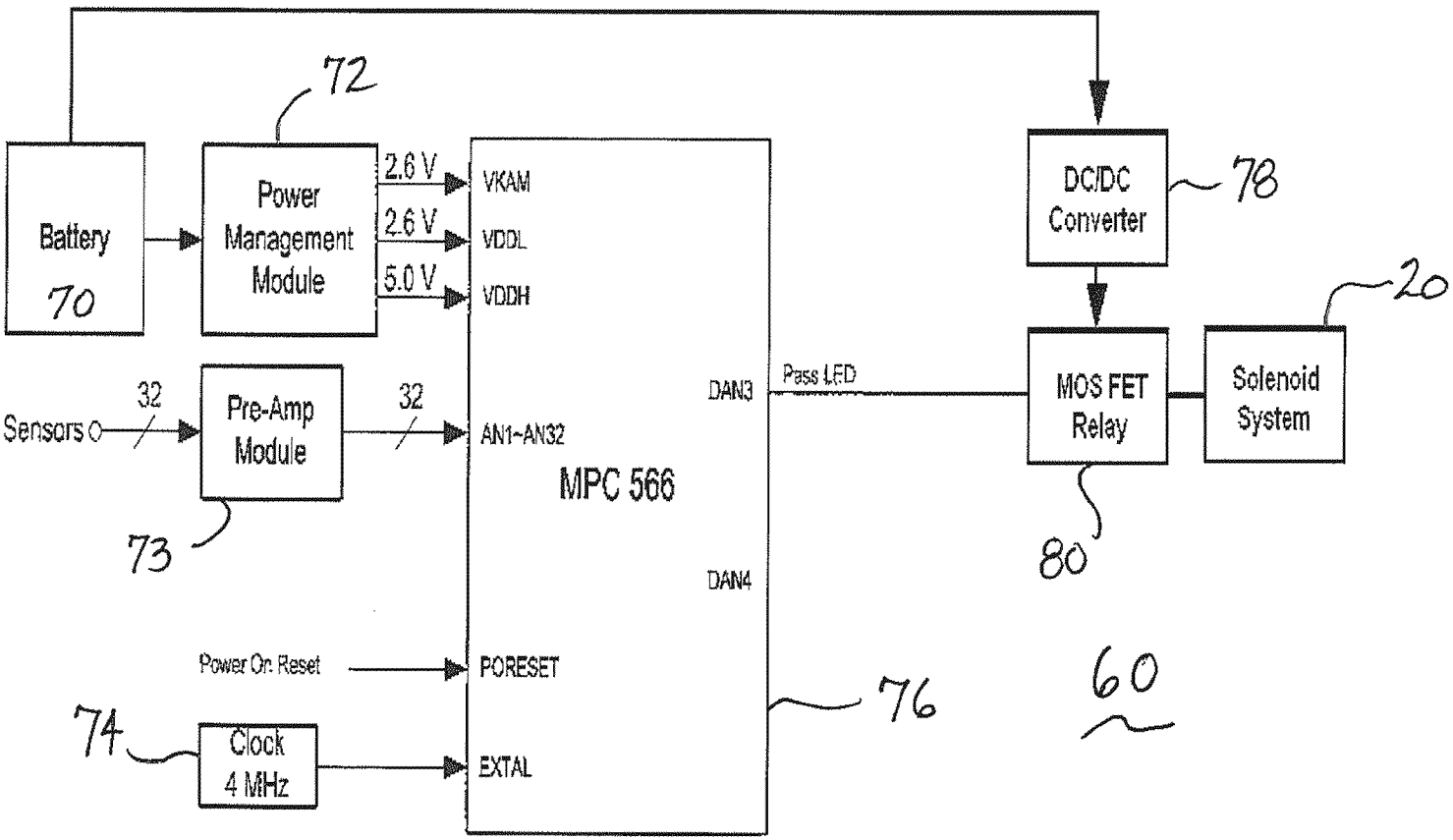
FIG. 9 is a schematic diagram of an electrical design of a solenoid firing inhibition system in accordance with one embodiment of the present disclosure.

Now referring to FIG. 9, an embodiment of a solenoid firing inhibition system 60 in accordance with the presently disclosed subject matter includes a solenoid 20, a power source 70, power management module 72, pre-amplification module 73, clock 74, microcontroller 76, converter 78, and switch 80. Microcontroller 76 is initially programmed with pressure signature data from an authorized user. Once the data is programmed in the microcontroller 76, if the pressure signature which is detected by the microcontroller is different than the pressure signature of the individual for whom the weapon is programmed the weapon will not discharge.

The configuration in this embodiment utilizes two indication signals (Pass/Fail) provided by the microcontroller 76, in this example a MPC566 32 bit microcontroller available from Freescale Semiconductor at www.freescale.com, through its digital I/O line at the end of a dynamic grip recognition program to determine the firing/blocking operation. The "Pass" signal is implemented to activate the electrical switch, in this example, a MOSFET relay. For an authorized user, the firing system may be enabled by a logic high signal. With further reference to FIG. 3, the plunger 22 of the solenoid 20 is retracted away from the block on the trigger bar 4 to enable the firing activity. Suitable electrical switch 80 and DC/DC converter 78 are employed to generate fast response of the solenoid firing system 60 compared with the speed of normal trigger transmission system. For an unauthorized user, the electrical switch 80 remains in the "off" mode with a logic low signal, the solenoid 20 is not activated and the plunger 22 remains disposed to block movement of the trigger bar 4.

It will be apparent to the skilled artisan that any suitable power source (preferably a battery), electrical switch, clock, pre-amplification module, DC/DC converter and/or power management module may be employed in connection with the present subject matter. Applicants have found that in consideration of the requirements of the trigger activity transmission speed, power efficiency, and compact dimension, the components listed in Tables 3 and 4 are good choices for embodiments described herein. However, alternative components may be utilized as well.

TABLE 3

Parameters of electrical switch

| Model Number | Max turn on time (VDD = 20 V IF = 5 mA) (ms) | Max turn off time (VDD = 20 V IF = 5 mA) (ms) | Max supply voltage (V) | Switch threshold voltage (VDC) | Dimension (mm) | Power (W) |
|---|---|---|---|---|---|---|
| Toshiba MOSFET relay TLP3122 | 3 | 1 | 48 | 1.15 | 7 × 4.4 × 3.9 | 2 |

TABLE 4

Key parameters of DC/DC converter

| Model Number | Voltage input (VDC) | Voltage output (VDC) | Dimension (mm) | Power (W) | Mounting type |
|---|---|---|---|---|---|
| CUI Inc VWRBS2D5-S24-SIP | 4.5~9 | 24 VDC@80 mA | 22 × 12 × 9.5 | 2 | Through Hole |

Figure 10:
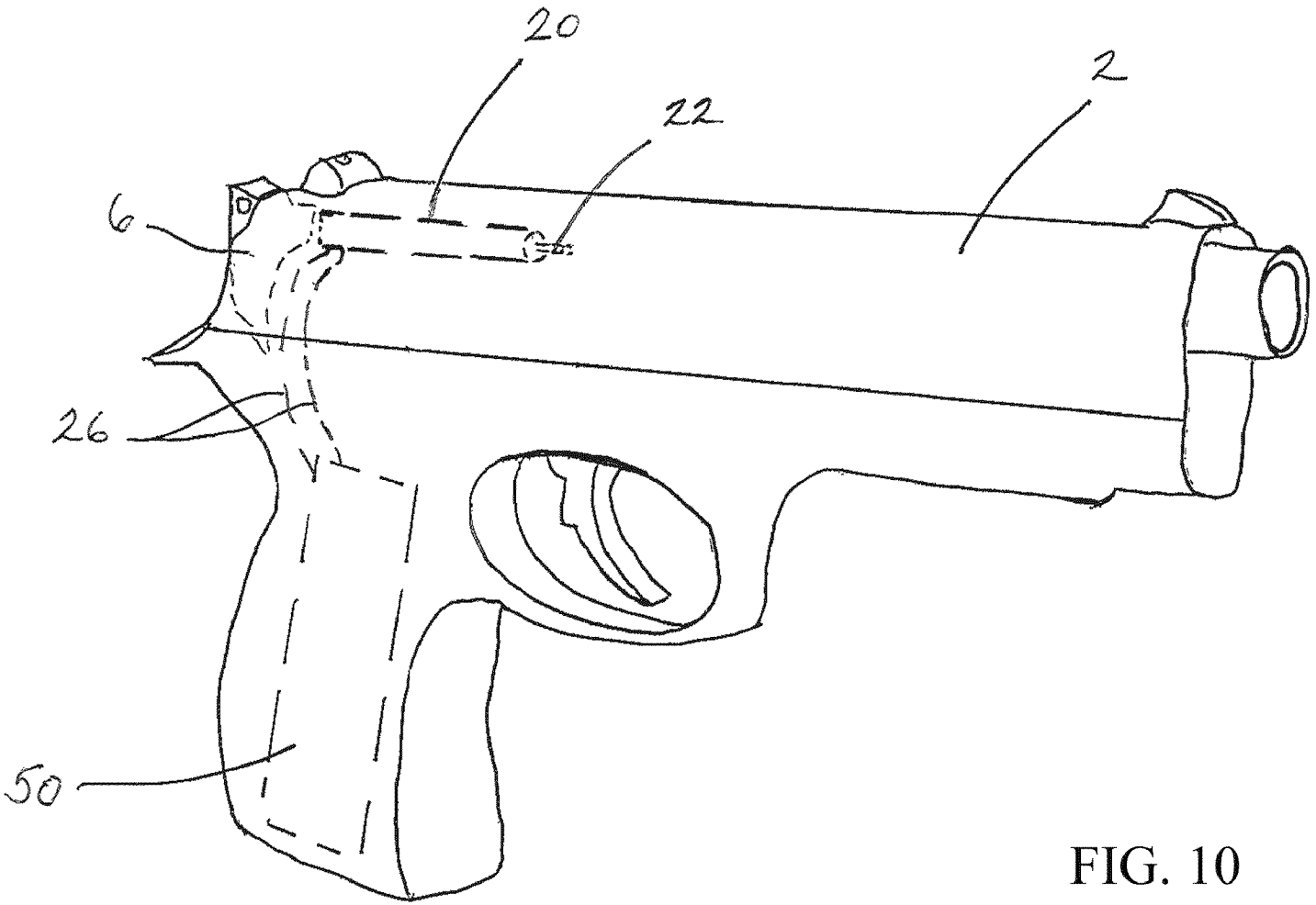
FIG. 10 is a side perspective view of a firearm including a solenoid percussion system in accordance with one embodiment of the present disclosure.

Now referring to FIG. 10, a firing pin-based solenoid mechanical percussion apparatus for a firearm 2 includes a solenoid 20 and dynamic grip recognition module 50, which system is based on replacing the firing pin of a firearm with an axial solenoid. Suitable solenoids include tubular solenoids available commercially for example from Magnetic Sensor Systems of Van Nuys, Calif. Two modes of operation can be employed. In the first, the solenoid 20 reduces the impact force from the hammer sufficiently to prevent primer detonation. The second mode of operation employs a permanent reduction of the hammer impact force by changing the restoring rate of the metal spring that drives the hammer. When a "Go" signal is issued from the dynamic grip recognition module 50, the solenoid 20 is actuated to generate a force complementary to the hammer force so the totality of two forces is adequate to detonate the primer. In one embodiment, a solenoid 20 is employed which is powerful enough to detonate the primer, thereby eliminating the need for a hammer.

As will be apparent to the skilled artisan, the fit, placement and orientation of the solenoid 20 in the firearm 2 are dependent on the make and model of the firearm and the desired mode of firing inhibition.

Figure 11:
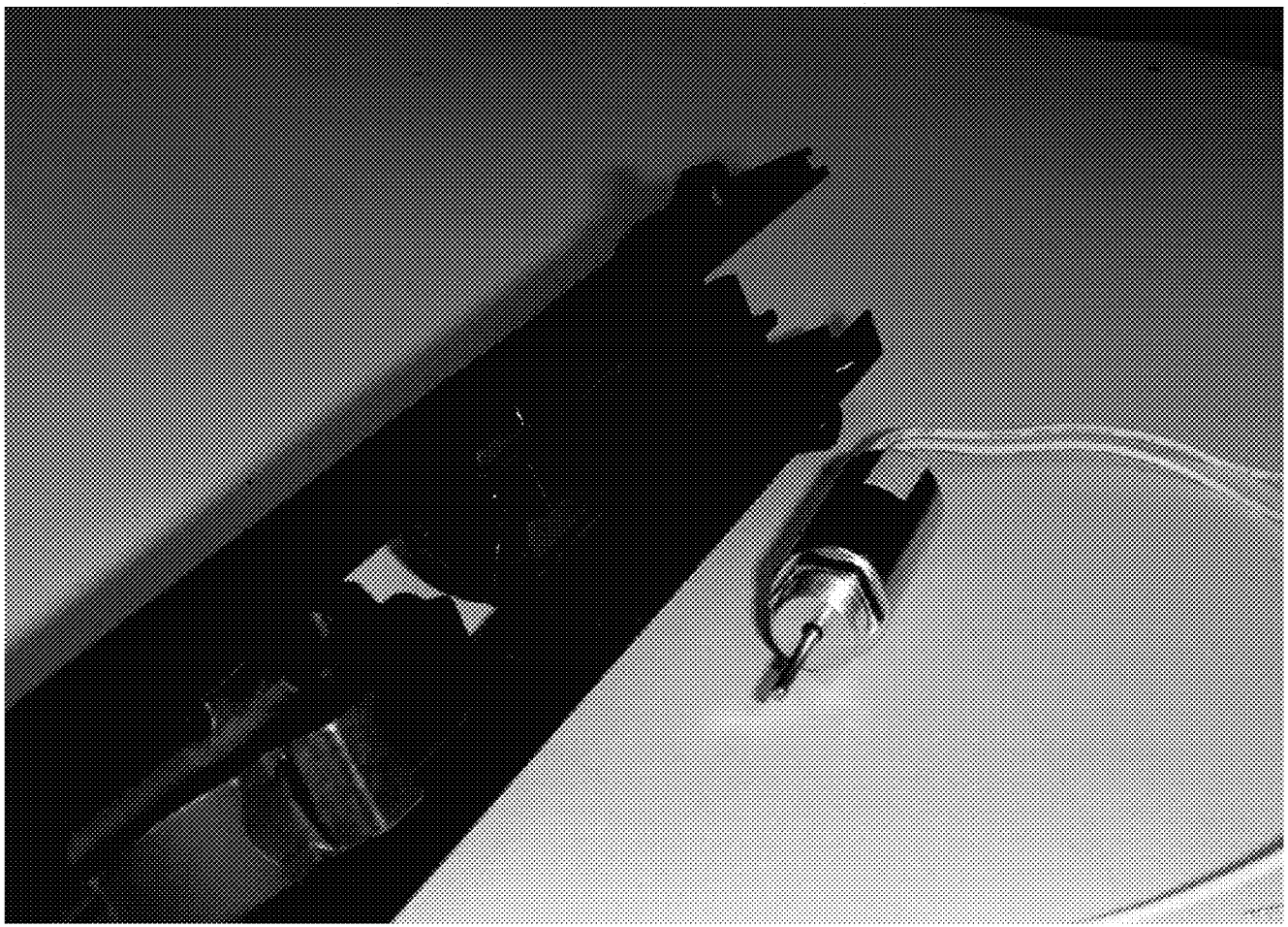
FIG. 11 is a photographic bottom side view of a slide of a pistol and a solenoid for installation in a firearm in accordance with one embodiment of the present disclosure.

The conventional mechanical firing pin may be replaced with a solenoid plunger for multiple exemplary embodiments of the present invention. The diameter of the plunger tip for one such embodiment is similar to that of the conventional firing pin. FIG. 11 shows the slide of a pistol and an exemplary solenoid, SMT-1325S12A available from Jameco Electronics of Belmont, Calif. for one embodiment of the present invention.

Figure 12:
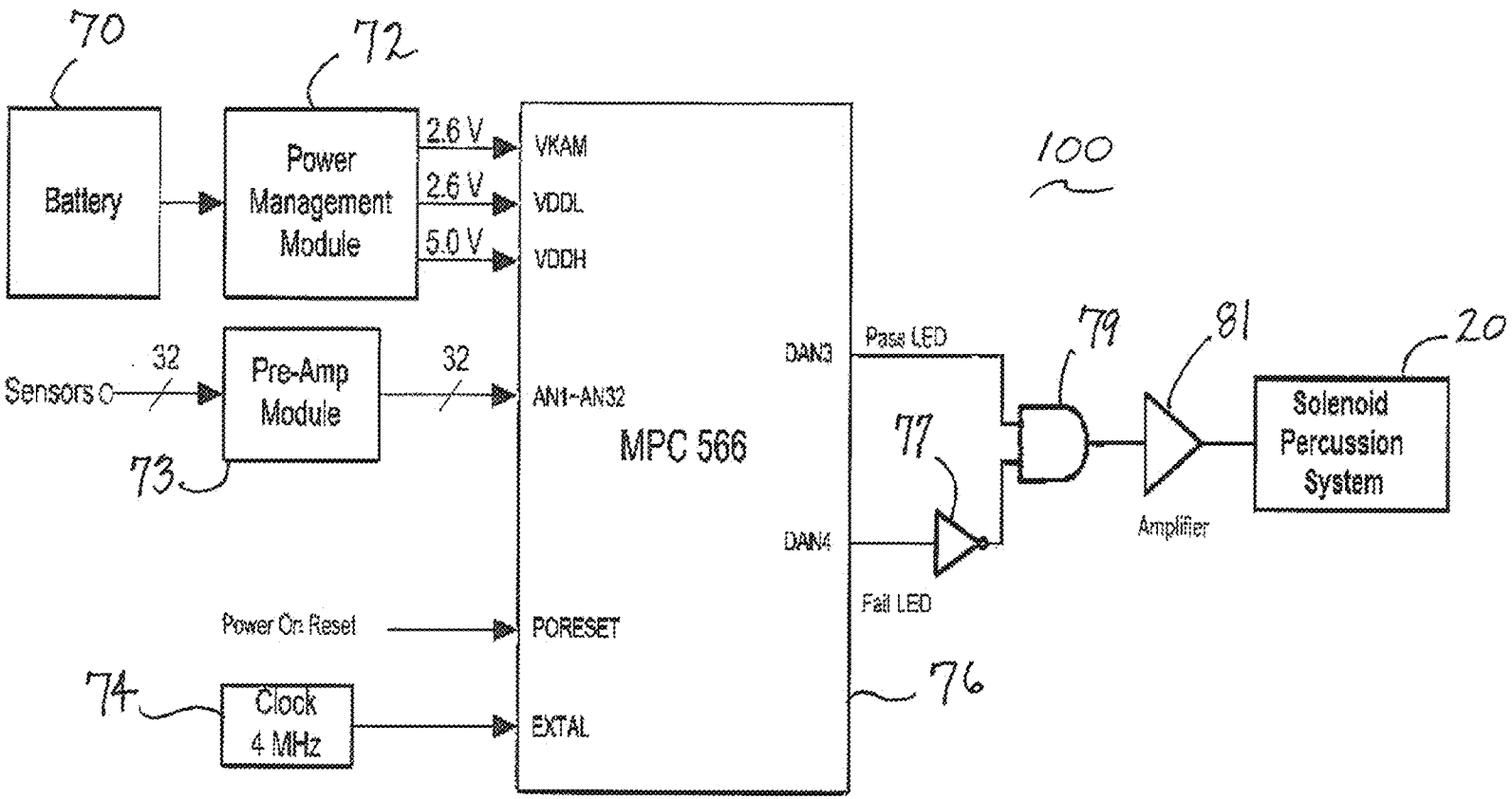
FIG. 12 is a schematic diagram of an electrical design of a solenoid percussion system in accordance with one embodiment of the present disclosure.

Now referring to FIG. 12, the electrical design of a solenoid percussion system 100 may include a solenoid 20, a power source 70, power management module 72, pre-amplification module 73, clock 74, microcontroller 76, inverter 77, AND gate 79 and amplifier 81. The configuration utilizes two indication signals (Pass/Fail) provided by the microcontroller, in this case a MPC566 32 bit microcontroller available from Freescale Semiconductor through its digital I/O line at the end of the dynamic grip recognition program to determine the firing/blocking operation. The "Pass" and the inverted "Fail" signals are ANDed and then amplified. For an authorized user, the firing system is enabled by a logic high signal and disabled by a logic low signal for an unauthorized user.

The electronics of the solenoid percussion systems 60 and 100 described herein above may be included in the dynamic grip recognition module 50 along with sensors as will be described further herein below.

In order to select a proper solenoid to inhibit/disable firing, it is desirable to determine the detonation characteristics of the primer, namely, energy, velocity and momentum that should be delivered by the striking pin. A number of primer detonation tests based on the fixture and primers were conducted. Some parameters and operating conditions play an important role in the detonation while most of the others have very little if any effect. Table 5 lists the results of the primer detonation tests.

TABLE 5

Primer detonation test

| Condition description | Test data and conclusion |
|---|---|
| Sharpness of the firing pin tip | There is no significant effect on primer detonation with various firing pin diameters. |
| Travel speed of the firing pin | 127 mm/sec.------no detonation;<br>133.35 mm/sec.----no detonation;<br>167.64 mm/sec.--- no detonation;<br>203.2 mm/sec.---- detonation. |
| Mass of the firing pin | Lowering the travel speed regardless of the mass attached to the firing pin did not detonate the primer. In some cases the pin pierced the primer with no detonation. |
| Position of the primer | Reversing the primer did not help. |
| Thickness of the primer | Thinning the primer did very little help: the primer with thickness 0.33 mm can be detonated; one primer detonated but was driven back over the firing pin. |

According to the primer detonation test results, the solenoid percussion system should be able to actuate fast enough to fire a bullet. The minimum speed for firing in at least one embodiment has been determined to be approximately 203.2 mm/sec. As will be apparent to the skilled artisan from the foregoing, this minimum speed can be exploited to inhibit firing using the present teachings.

As described above, exemplary embodiments of the disclosed subject matter employ a dynamic grip recognition module 50 to obtain biometric measurements of a user. Now referring to FIGS. 13A-14C, the dynamic grip recognition module 50 in one embodiment includes a plurality of sensors 105 on a printed circuit board (PCB) 110 along with associated electronics for signal processing and system control, all of which are located in the grip of a firearm. In one aspect, the systems described herein above with reference to FIGS. 9 and 12 may be placed on one or more PCBs to operate in conjunction with sensors 105 placed in the grip of a firearm. Temporal signature of user grip pressure immediately before firing is measured by sensors 105 in the firearm grip and analyzed in real-time by the signal processing electronics. Sensors 105 are preferably tactile pressure sensors and may be piezoelectric, piezoresistive, capacitive, etc. The number of sensors 105 shown in the drawings is exemplary only.

Now referring to FIG. 13A a firearm left side hand grip 9 includes a microcontroller 76, sensors 105, PCB 110, power and I/O connector 120, and BDM port 130. The PCB in accordance with this embodiment may be designed in a geometric shape similar to that of the grip. The sensors 105 are disposed on the front side as shown in the front view in FIG. 13A. Now referring to FIG. 13 B, the microcontroller 76 and all related electronic components may be located on the opposite side of the grip 9. Now referring to FIG. 13C, the assembly of the left hand side grip 9, microcontroller 76, PCB 110 and sensors 105 are shown.

Figures 14A, 14B, 14C:
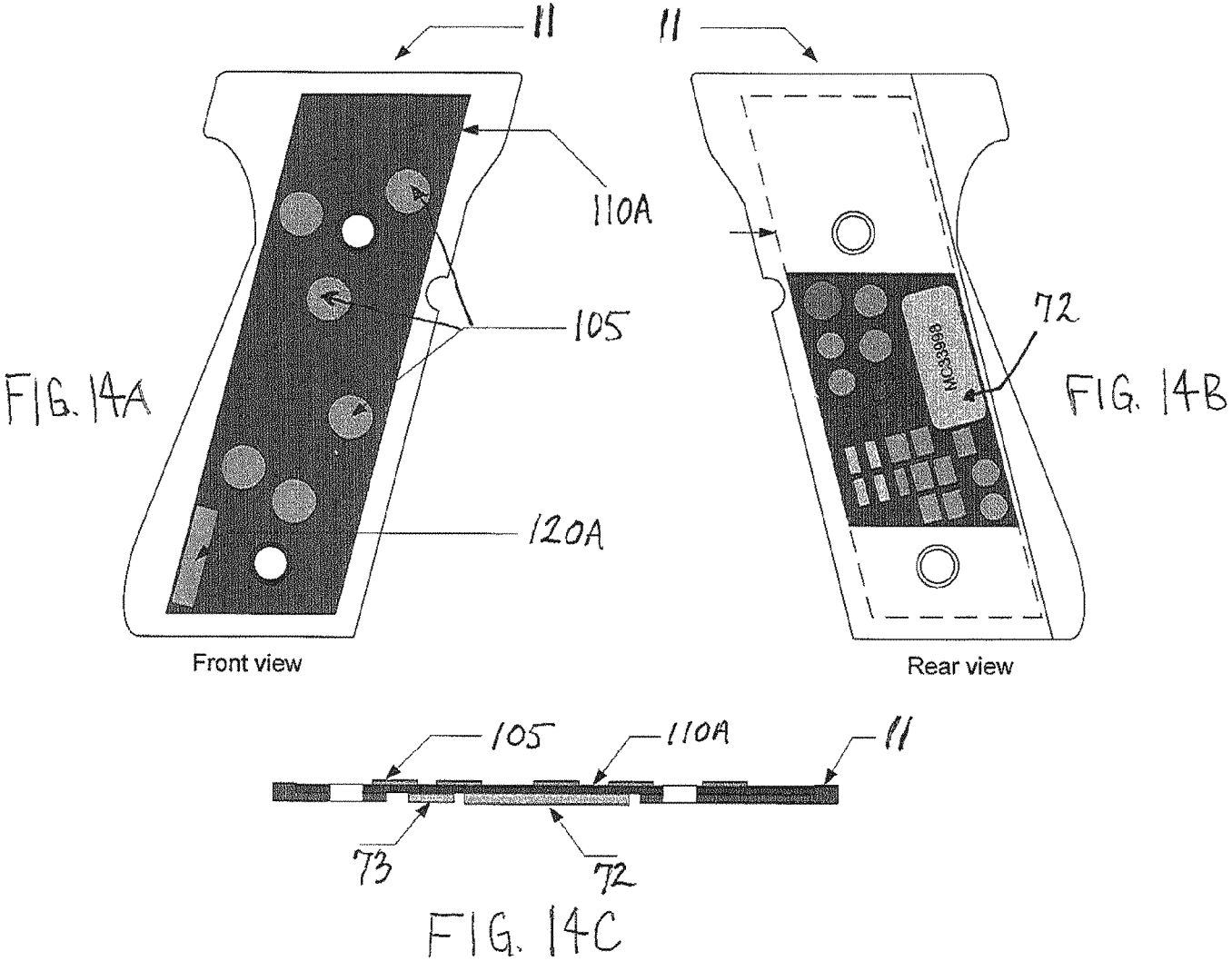
FIGS. 14A-14C are schematic diagrams depicting front (FIG. 14A), rear (FIG. 14B) and side (FIG. 14C) views of a right side hand grip of a firearm including elements of a dynamic grip recognition module in accordance with one embodiment of the present disclosure.

Now referring to FIG. 14A, the right side grip 11 may include further sensors 105 and power and I/O connector 120A on another PCB 110A. Now referring to FIGS. 14B-14C, the power management module 72 and pre-amplifier 73 and associated electronics are located on the opposite side of PCB 110A. The communication between the two PCBs 110 and 110A can be established for example via flat flex cable (not shown). Rubberization can be added on top of the assembly for better gripping as well as protection of the components.

Although the systems and methods of the present disclosure have been described with reference to exemplary embodiments thereof, the present disclosure is not limited thereby. Indeed, the exemplary embodiments are implementations of the disclosed systems and methods are provided for illustrative and non-limitative purposes. Changes, modifications, enhancements and/or refinements to the disclosed systems and methods may be made without departing from the spirit or scope of the present disclosure. Accordingly, such changes, modifications, enhancements and/or refinements are encompassed within the scope of the present invention.

What is claimed is:

1. A firing inhibition system for a firearm comprising an electromechanical actuator comprising a solenoid electrically connected to a dynamic grip recognition module comprising at least one sensor and a microcontroller, wherein the solenoid is positioned in the firearm in the location of a firing pin and the firing pin is removed and wherein the at least one sensor is located in a portion of a firearm operable to receive grip pressure from a user and wherein the at least one sensor is operable to transmit a signal to the microcontroller, wherein the microcontroller is operable to receive programming comprising grip pressure of an authorized user and is operable to interpret whether the grip pressure of the user matches the grip pressure of the authorized user, and to send a signal to the electromechanical actuator to actuate or to not actuate wherein the solenoid is operable to generate a force complementary to a permanent reductive impact force of a hammer of the firearm which is achieved by changing the restoring rate of a metal spring that drives the hammer, wherein when a signal is issued from the dynamic grip recognition module, the solenoid is actuated to generate a force complementary to the hammer force so the totality of two forces is adequate to detonate a primer.

2. A firing inhibition system according to claim 1 wherein the solenoid is positioned in the firearm to inhibit motion of a trigger bar of the firearm.

3. A firing inhibition system according to claim 2 further comprising at least one block fixed on a surface of the trigger bar operable as a stop against which a plunger of the solenoid may contact.

4. A firing inhibition system according to claim 1 wherein the solenoid is operable to reduce impact force from a hammer of the firearm to prevent primer detonation.

5. A firing inhibition system according to claim 1 wherein the solenoid actuates with a speed sufficient to detonate primer of a cartridge.

6. A firing inhibition system according to claim 5 wherein the solenoid has an actuation speed of at least 203.2 mm/sec.

7. A firing inhibition system according to claim 1 wherein the dynamic grip recognition module comprises a plurality of sensors disposed on at least one printed circuit board dimensioned to be located in the grip of a firearm.

8. A firing inhibition system according to claim 7 wherein the sensors are operable to obtain a temporal signature of user grip pressure before an act of firing is commenced and transmit signature information to the microcontroller.

9. A firing inhibition system according to claim 7 wherein the at least one printed circuit board comprises the microcontroller and a power and input/output connector.

10. A firing inhibition system according to claim 1 wherein at least one of the sensors is a tactile pressure sensor.

11. A firing inhibition system according to claim 1 wherein the at least one printed circuit board comprises a power management module and a pre-amplifier and optionally a battery.

12. A firing inhibition system according to claim 1 wherein the dynamic grip recognition module comprises a first and second printed circuit board, wherein the first printed circuit board is associated with a left side of a firearm grip and the second printed circuit board is associated with a right side of the firearm grip, and the first and second printed circuit boards are electrically connected, wherein one of the printed circuit boards includes the microcontroller and the other printed circuit board includes at least a plurality of sensors.

13. A firing inhibition system according to claim 12 wherein one of the printed circuit boards further comprises a power and input/output connector.

14. A firing inhibition system according to claim 12 wherein one of the printed circuit boards further comprises a power management module and a pre-amplifier and optionally a battery.

15. A firing inhibition system according to claim 12 wherein one of the printed circuit boards further comprises a clock, converter, switch, amplifier, and/or AND gate operably linked to the microcontroller.

16. A firing inhibition system according to claim 1 further comprising a battery operably linked to the microcontroller.

* * * * *